US005513914A

United States Patent [19]

Faber

[11] Patent Number: 5,513,914

[45] Date of Patent: May 7, 1996

[54] ARTICLE-CARRYING STRUCTURE

[75] Inventor: Carole Faber, New York City, N.Y.

[73] Assignee: Modern Arts Packaging, Inc., New York, N.Y.

[21] Appl. No.: 27,816

[22] Filed: Mar. 8, 1993

[51] Int. Cl.[6] ..... B65D 33/02; B65D 33/08

[52] U.S. Cl. ..... 383/10; 229/68.1; 281/38; 283/56; 383/119; 383/127

[58] Field of Search ..... 383/127, 119, 383/10; 229/68 R; 283/56, 116; 281/38

[56] References Cited

U.S. PATENT DOCUMENTS

| | | | |
|---|---|---|---|
| 960,384 | 6/1910 | Norman | 229/68 R |
| 1,434,097 | 10/1922 | Conner | 229/68 R |
| 2,145,500 | 1/1939 | Townsend | 229/68 R |
| 2,165,195 | 7/1939 | Sawdon | 229/68 R |
| 2,219,526 | 10/1940 | McLaren | 229/68 R |
| 3,111,256 | 11/1963 | Hiersteiner | 229/68 R |
| 3,334,804 | 8/1967 | Watts, Jr. | 383/119 |
| 3,414,185 | 12/1968 | Young | 229/68 R |
| 3,850,724 | 11/1974 | Lehmacher | 383/10 |
| 4,084,696 | 4/1978 | Katz | 283/56 |
| 4,577,889 | 3/1986 | Schulz | 281/38 |
| 5,141,252 | 8/1992 | Michlin | 229/68 R |

FOREIGN PATENT DOCUMENTS

| | | |
|---|---|---|
| 0034499 | 8/1981 | European Pat. Off. . |
| 3234164 | 10/1991 | Japan . |

*Primary Examiner*—Stephen P. Garbe
*Attorney, Agent, or Firm*—Cobrin Gittes & Samuel

[57] ABSTRACT

An article-structure comprises a bag that can be folded into a substantially flat configuration, and bound in a conventional manner into a magazine. The bag includes reinforcing element for maintaining the structural integrity of the bag when the bag is removed from the magazine and deployed. The reinforcing element includes a second attachment side, which may be constructed of conventional cardboard. The second attachment side that reinforces the bag forms a detachable portion of an attachment bound into the magazine in a conventional manner. The bag may contain printed material or graphical material on at least one outer surface. Handle elements may be provided in the bag to facilitate carrying by a user when the bag is in the deployed state.

6 Claims, 6 Drawing Sheets

10
12
14
16
18
20
22
24
26
28
30
32
34
36

ARTICLE-CARRYING STRUCTURE

BACKGROUND OF THE INVENTION

This invention relates generally to structures for carrying objects, and, more particularly, relates to an article-carrying structure adapted for binding into a conventional magazine and a method therefor.

In the field of advertising there exists a constant requirement for novel methods for effectively advertising a product or a company. In many cases, a unique and imaginative advertising tactic can greatly enhance the sales of a product.

In recent years, many commercial entities have provided promotional samples of their products as a means of marketing these products. In particular, certain cosmetic and perfume companies have published fashion magazine advertisements that include a fabric or paper swatch containing the scent of the perfume product to be marketed.

The above-noted advertising methods, however, have associated drawbacks. A campaign providing free samples of a product, for example, may be excessively expensive, and it may be difficult to distribute the sample to a specific market target group. In the case of scented fragrance advertisements, on the other hand, such advertisements have a brief effective life, limited by either the dissipation of the aromatic elements or the disposal of the magazine in which the advertisement appears.

It is accordingly an object of the invention to provide an effective advertising device that has utility to the consumer apart from its utility as an advertising device, so that the device will remain in public use for a substantial period of time.

It is another object of the invention to provide such a device which is relatively inexpensive.

It is yet another object of the invention to provide such a device which is adapted to conventional binding techniques, for binding into a magazine.

Other general and specific objects of the invention will in part be obvious and will in part appear hereinafter.

SUMMARY OF THE INVENTION

The foregoing objects are attained by the invention, which is an article-carrying structure that can be bound in a conventional manner into a magazine.

In accordance with one aspect of the invention, the article-carrying structure is a bag that can be folded into a substantially flat configuration. The bag includes attachment elements which may serve a dual function of attaching the article-carrying structure to the magazine and for maintaining the structural integrity of the bag when the bag is removed from the magazine and deployed. Because of this dual function the attachment means will hereinafter be referred to as either the attachment element, the attachment mechanism, or as the reinforcing element.

In accordance with another aspect of the invention, the reinforcing element may be constructed of conventional cardboard or paper. A second attachment side reinforces the bag and forms a detachable part of the attachment element 14, which attachment element 14 is bound into the magazine in a conventional manner. The bag may contain printed material or graphical material on at least one outer surface.

In accordance with a further aspect of the invention, handle elements may be provided in the bag to facilitate carrying by a user when the bag is in the deployed state.

The invention will next be described in connection with certain illustrated embodiments; however, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and the accompanying drawings, in which.

DESCRIPTION OF ILLUSTRATED EMBODIMENTS

Figure 1:
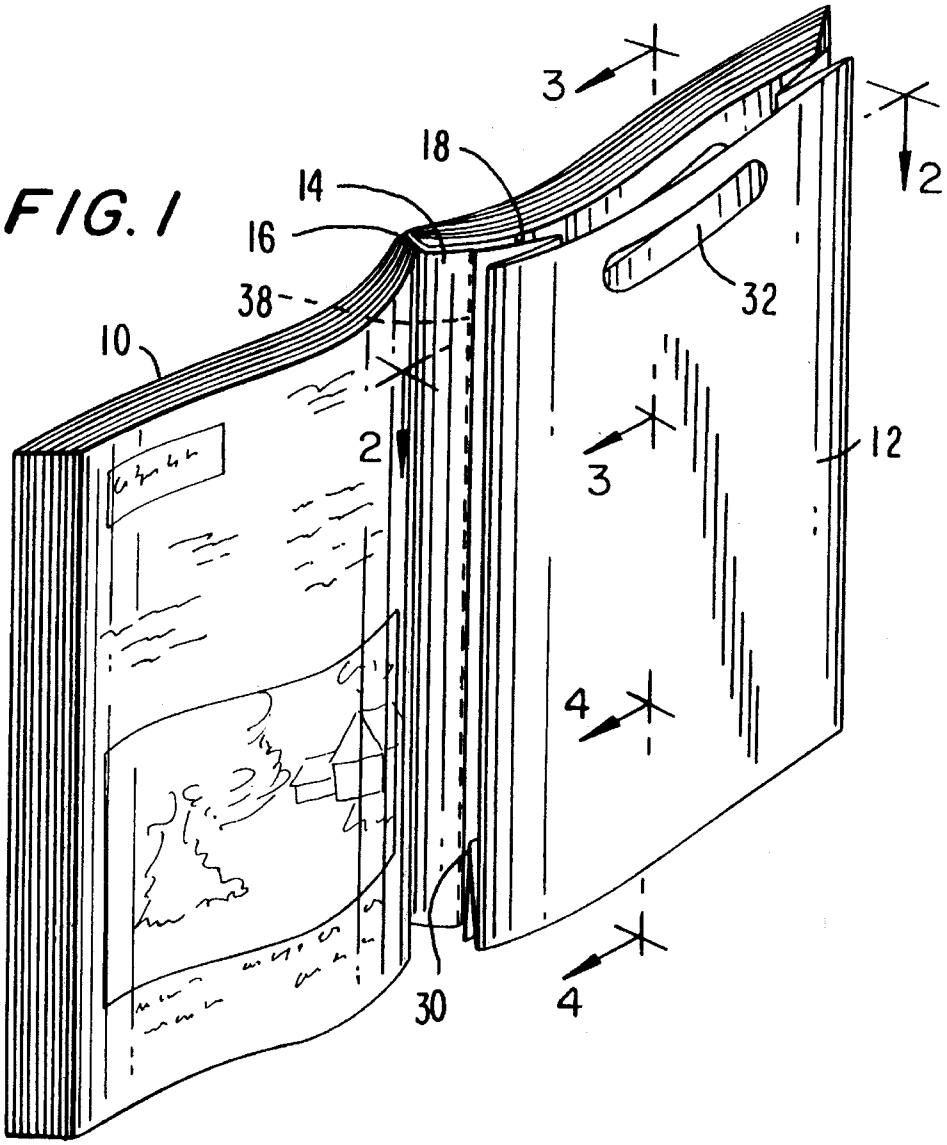
FIG. 1 is a perspective view of an article-carrying structure constructed in accordance with the invention.

FIG. 1 is a perspective view of an article-carrying structure 12 constructed in accord with the invention. As illustrated in FIG. 1, the article-carrying structure 12 can be folded into a substantially flat configuration, and bound in a conventional manner into a magazine 10. The article-carrying structure 12 includes attachment element 14 having a second attachment side 18 which will be discussed hereinafter, for maintaining the structural integrity of the article-carrying structure 12 when the article-carrying structure 12 is removed from the magazine 10 and deployed for use. The attachment element 14 includes 14 also referred to as the attachment element 14 which binds the article-carrying structure 12 into the magazine 10 which may be constructed of conventional cardboard. The second attachment that reinforces 18 the article-carrying structure 12 forms a detachable portion of the attachment element 14 bound into the magazine 10 in a conventional manner. The article-carrying structure 12 may contain printed material or graphical material on at least one outer surface. Handle elements may be provided in the article-carrying structure 12 to facilitate carrying by a user when the article-carrying structure 12 is in the deployed state.

In particular, FIG. 1 shows that the article-carrying structure 12 is attached to the magazine 10 by means of an attachment element 14 which may be made up of a card 14 which is attachable into the magazine 10. A first attachment side 16 of the attachment element 14 may be attached to the magazine 10 and a second attachment side 18 also referred to as the rib structure of the attachment element 14 may be attached to the article-carrying structure 12.

Figures 2, 3, 4:
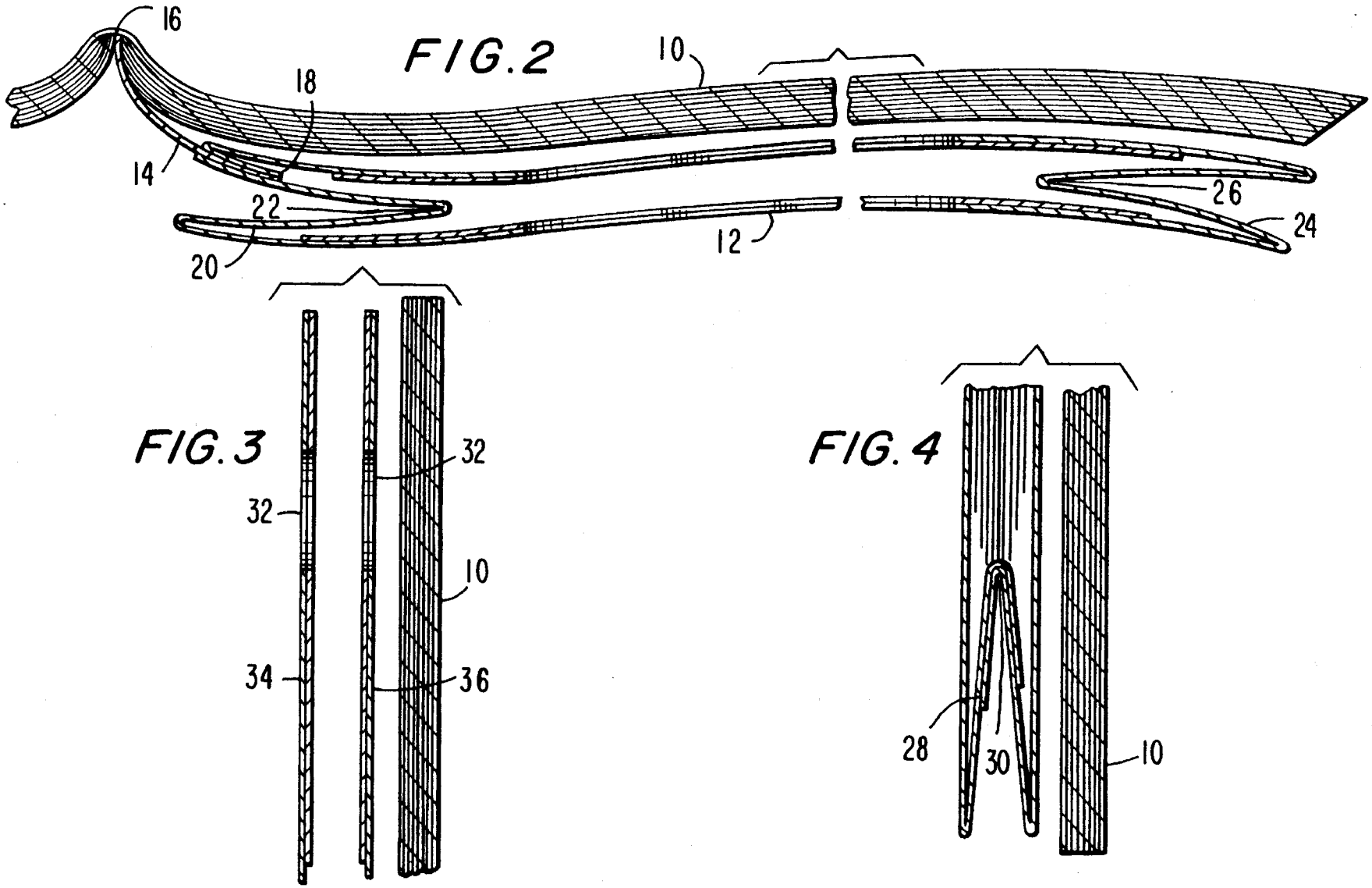
FIG. 2 is a cross sectional top view of a article-carrying structure constructed in accordance with the invention, sectioned along the line 2—2 of FIG. 1; showing details of attachment points and the positional relationship between the article-carrying structure and a magazine into which the article-carrying structure is bound.
FIG. 3 is a cross sectional side view of a article-carrying structure constructed in accordance with the invention, sectioned along the line 3—3 of FIG. 1, including details of handles and the open end of the article-carrying structure.
FIG. 4 is a cross sectional side view of an article of manufacture in accordance with the invention, sectioned along the line 4—4 of FIG. 1; including details of the bottom fold in the article-carrying structure.

As FIG. 2 illustrates, the rib structure portion of the attachment element 14 may reinforce and support the article-carrying structure 12 during removal from the magazine 10 and during deployment and use of the article-carrying structure 12. FIG. 2 also shows that the article-carrying structure 12 may have a first side 20, which may have a first fold 22, and a second side 24, which may have a second fold 26.

As FIG. 4 illustrates, the article-carrying structure 12 may also have a bottom 28 which may have a third fold 30. The first fold 22, second fold 26 and third fold 30, may be used to selectively flatten the article-carrying structure 12 while the article-carrying structure 12 is bound into the magazine 10, or while the article-carrying structure 12 is being stored once it has been removed from the magazine 10. The folds also permit the article-carrying structure to be expanded when in the open or deployed state.

FIG. 3 shows that the article-carrying structure 12 may have handles 32 formed in the article-carrying structure 12 in a front 34 and a rear 36 proximate to a top of the article-carrying structure 12.

Figure 5:
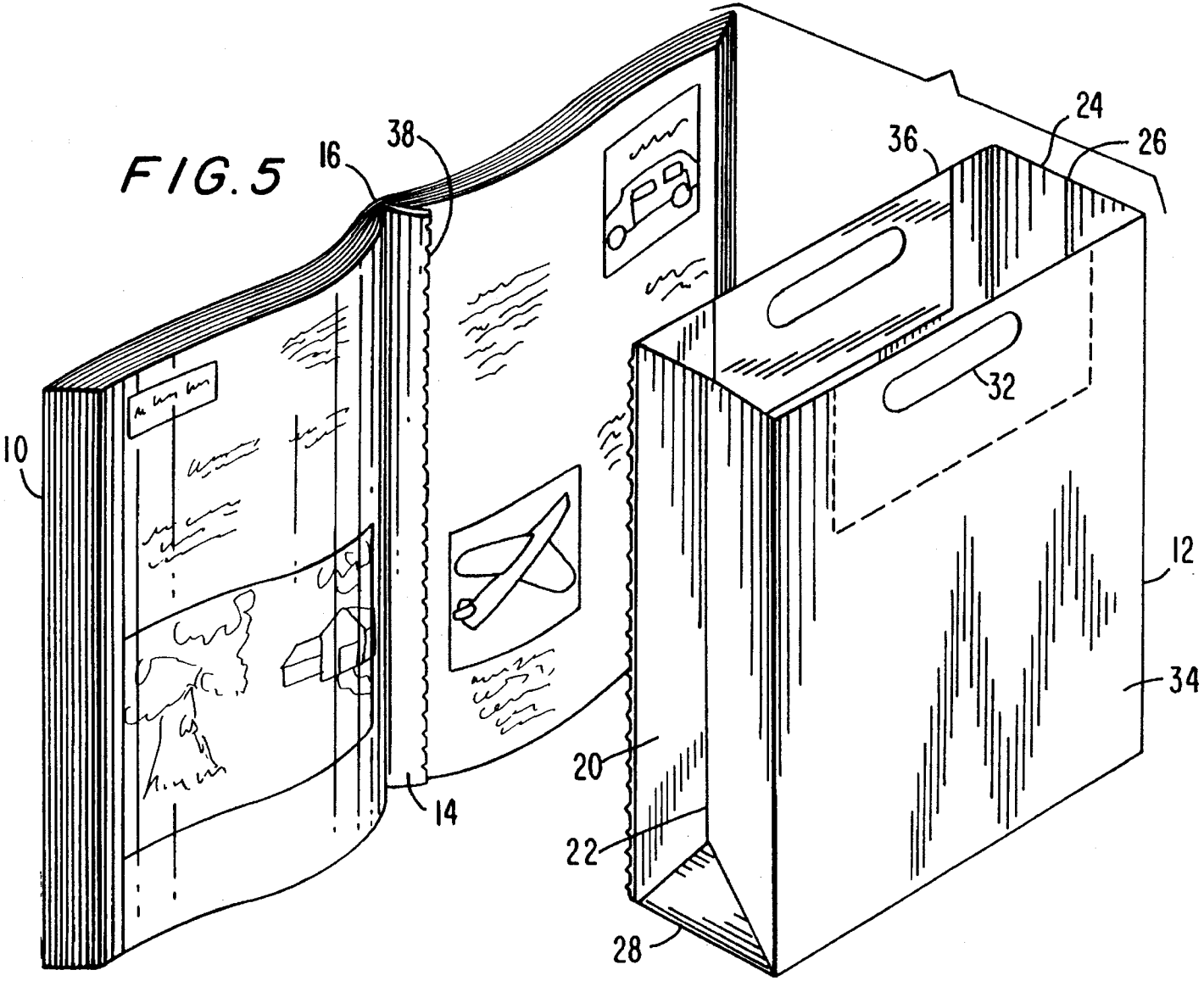
FIG. 5 is an exploded, perspective view of an article of manufacture in accordance with the invention, with the article-carrying structure in an open state, removed from the magazine, including details of the perforated attachment mechanism.
Figure 6:
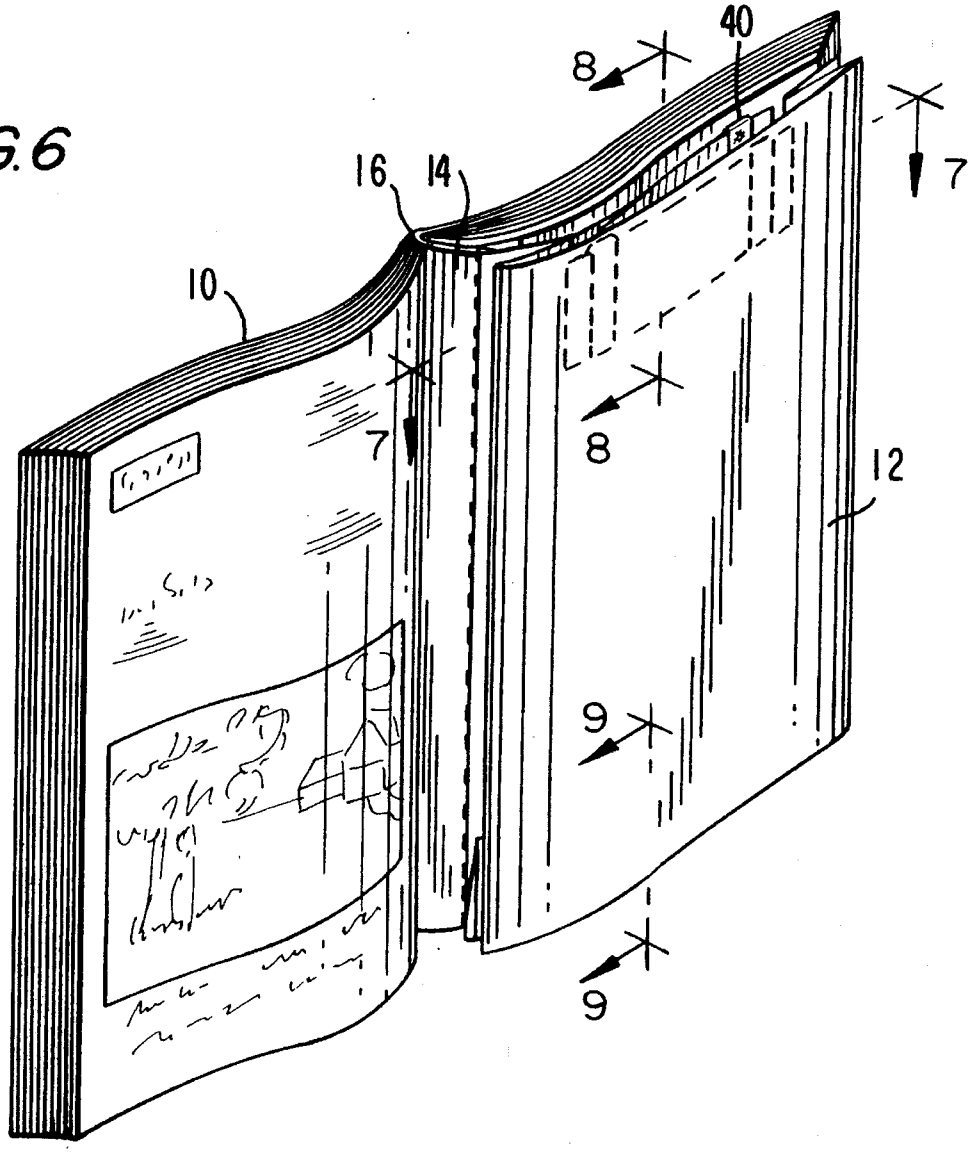
FIG. 6 is a perspective view of a second embodiment of an article of manufacture in accordance with the invention.
Figure 7:
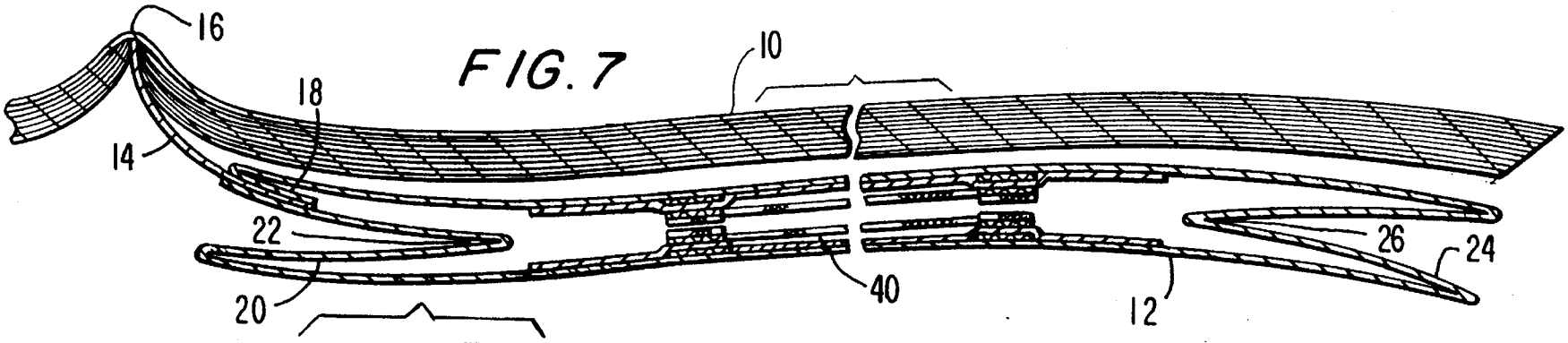
FIG. 7 is a cross sectional top view of a second embodiment of an article of manufacture in accordance with the invention, sectioned along line 7—7 in FIG, 6, including details of the attachment mechanism, the side folds in the article-carrying structure, and the position of the article-carrying structure relative to the magazine.
Figure 8:
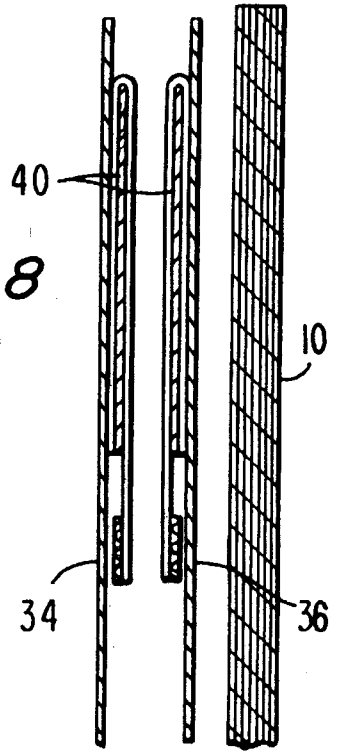
FIG. 8 is a cross sectional side view of a second embodiment of an article of manufacture in accordance with the invention, sectioned along line 8—8 of FIG. 6, including details of the handles and the open end of the article-carrying structure.
Figure 9:
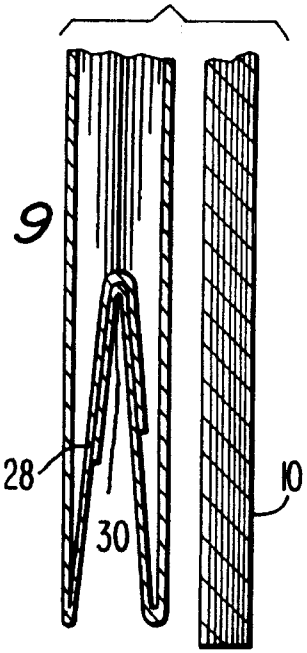
FIG. 9 is a cross sectional side view of a second embodiment of an article of manufacture in accordance with the invention, sectioned along line 9—9 of FIG. 6, including details of the bottom fold in the article-carrying structure.
Figure 10:
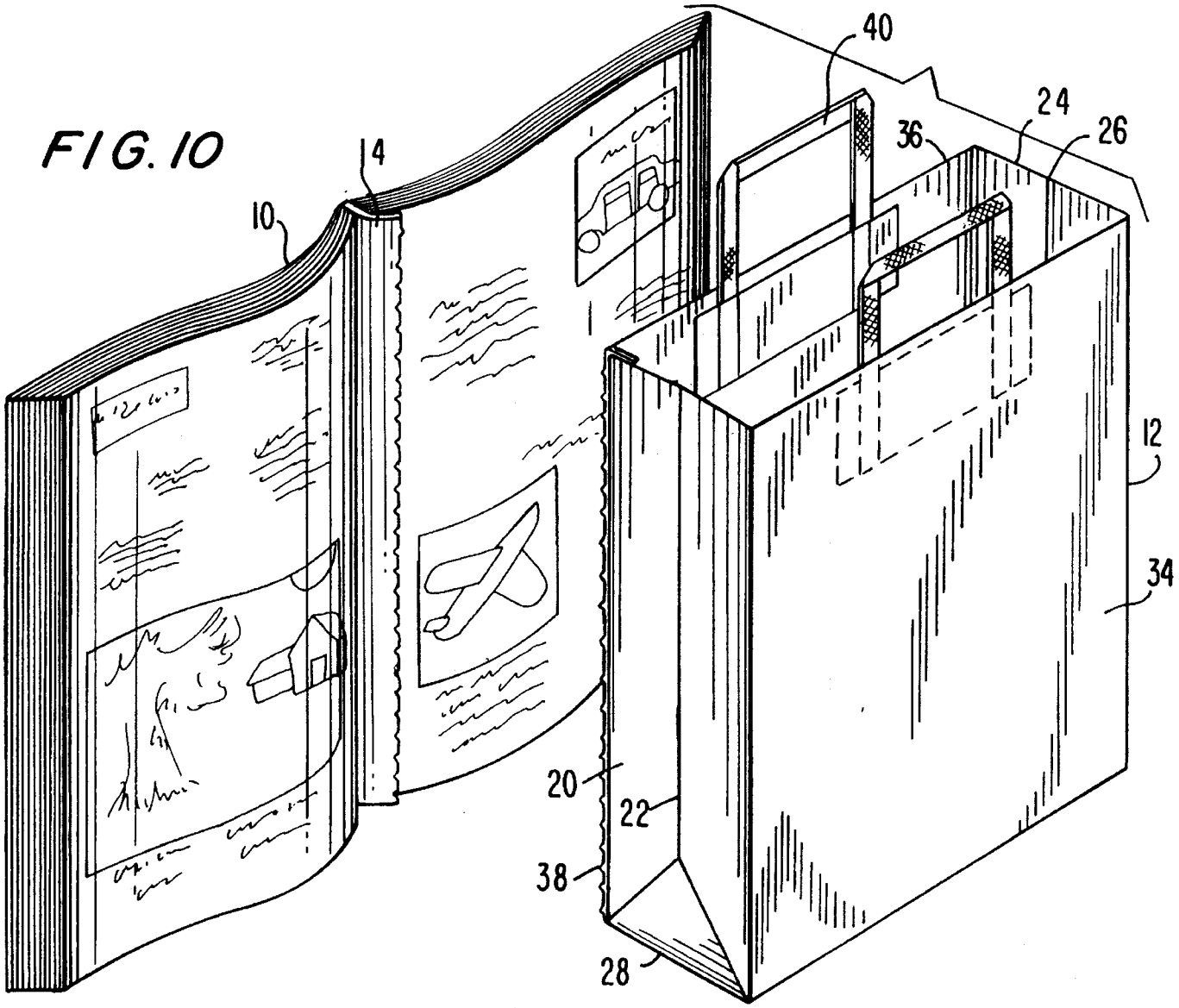
FIG. 10 is an exploded, perspective view of a second embodiment of an article of manufacture with the article-carrying structure in an open state, removed from the magazine.

As FIG. 5 illustrates, attachment element 14 may have perforations 38 separating the first attachment side 16 from the second attachment side 18. The intermediate portion is located on the card 14 such that when the article carrying structure 12 is removed from the magazine 10 the intermediate portion of the card 14 is not an element of the article-carrying structure 12.

FIGS. 6–10 depict an embodiment of the article-carrying structure wherein the article-carrying structure 12 includes handles 40 that are attached to the article-carrying structure 12 rather than formed in the article-carrying structure 12. As can be seen from FIGS. 6, 8 and 10, the handles 40 may be attached to the article-carrying structure 12 in such a way as to distribute stresses, related to carrying the structure, over a relatively large area. However, it should be noted that the handles 40 may be attached to the article-carrying structure directly as well. It can also be seen from FIGS. 6 and 8 that the handles 40 may be folded into the article-carrying structure 12 for storage and protection.

Those skilled in the art will appreciate that the handles on the article-carrying structure 12 can be of various configurations. The handles may be formed from rope, string, paper, cardboard, metal, plastic, rubber or any number of different materials or combinations of materials. Alternatively, the handles can be omitted.

The article-carrying structure can include further reinforcing elements about the handles formed in the article-carrying structure. Alternatively, the article-carrying structure may include handles attached directly to the article-carrying structure without reinforcement.

The article-carrying structure 12 can be attached to the magazine by the bottom or top of the article-carrying structure rather than the side of the article-carrying structure. The sides or bottom of the article-carrying structure can include a plurality of folds. Alternatively, the folds may be omitted. The article-carrying structure can be constructed from paper, plastic, coated paper or cardboard, or any combination thereof.

The article-carrying structure can also function as a motion-sickness bag that can be bound into travel magazines for use on airlines or other common carriers.

As discussed above, the article-carrying structure may provide an advertising function, carrying printed and/or graphical matter on an outer surface. In particular, since the article-carrying structure 12 may be attached to a magazine 10 by an attachment element 14 that allows for the removal of the article-carrying structure 12 from the magazine 10, once removed the article-carrying structure 12 can be used for carrying items such as store purchases, papers, or even the magazine 10 in which it was bound. Since the article-carrying structure 12 may display a company logo, slogan, or even photographic material thereon, the article-carrying structure provides a continual and enduring display of the selected image associated with the company or product.

It will thus be seen that the invention efficiently attains the objects set forth above, among those made apparent from the preceding description. In particular, the invention provides a utilitarian article-carrying structure that affords an advertising function. The structure is also efficient and inexpensive.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An article-carrying structure adapted for binding into a publication, comprising:

a bag structure having a top which may be opened, a bottom and a plurality of sides and an attachment element coupled to one of said plurality of sides of said bag structure having a first attachment side, a second attachment side and a perforation separating the first attachment side from the second attachment side wherein said perforation begins proximal the top of said bag structure and ends proximal said bottom, the first attachment side being attachable to the publication such that when attached to the publication said bag structure may be selectively opened without removing said bag structure from the publication, the second attachment side being coupled to a portion of the bag structure, wherein the second attachment side forms a reinforcing support for the bag.

2. An article-carrying structure according to claim 1, wherein said perforated attachment element is attachable to the publication by staples or glue.

3. An article-carrying structure according to claim 1 wherein said bag structure includes printed or graphical matter disposed on at least one exterior surface.

4. An article-carrying structure according to claim 1, wherein said bag structure includes a front portion having a front top portion, a rear portion having a rear top portion, a first side having a first fold, a portion of said first side being reinforced by the attachment element, a second side having a second fold, a bottom having a third fold, said first, second and third folds permitting said article-carrying structure to be flattened for storage and expanded during use, a first handle being formed in said front portion proximate to said front top portion, and a second handle being formed in said rear portion proximate to said rear top portion.

5. An article-carrying structure according to claim 4, wherein said handle comprises a hand-receiving aperture formed in said front portion.

6. An article-carrying structure according to claim 1, wherein said bag structure further comprises a front portion having a front top portion, a rear portion having a rear top portion, a first side having a first fold, a portion of said first side being reinforced by the attachment element, a second side having a second fold, a bottom having a third fold, said first, second and third folds permitting the article-carrying structure to be selectively flattened for storage and expanded during use, a first handle structure being fastened to said front portion proximate to said front top portion, the first handle structure including a first handle element and a first affixing element affixing said first handle to the bag structure, said affixing element distributing load over a relatively large surface area of the front portion, a second handle structure being fastened to said rear portion proximate to said rear top portion, the second handle structure including a second handle element, and a second affixing element affixing said second handle to the bag structure, the second affixing element distributing load over a relatively large area of the rear portion of the bag structure.

* * * * *